US010904671B2

(12) United States Patent
Lafort et al.

(10) Patent No.: US 10,904,671 B2
(45) Date of Patent: Jan. 26, 2021

(54) MINIATURE SPEAKER WITH ACOUSTICAL MASS

(71) Applicant: Sonion Nederland B.V., Hoofddorp (NL)

(72) Inventors: Adrianus Maria Lafort, Hoofddorp (NL); Rasmus Voss, Hoofddorp (NL); Dennis Jacobus Mattheus Mocking, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/284,299

(22) Filed: Feb. 25, 2019

(65) Prior Publication Data

US 2019/0268701 A1 Aug. 29, 2019

(30) Foreign Application Priority Data

Feb. 26, 2018 (EP) ..... 18158547

(51) Int. Cl.

| | |
|---|---|
| ***H04R 25/00*** | (2006.01) |
| ***H04R 17/00*** | (2006.01) |
| ***H04R 7/04*** | (2006.01) |
| ***H04R 1/28*** | (2006.01) |

(52) U.S. Cl.

CPC ..... *H04R 17/00* (2013.01); *H04R 1/2842* (2013.01); *H04R 1/2857* (2013.01); *H04R 7/04* (2013.01); *H04R 25/48* (2013.01); *H04R 25/65* (2013.01); *H04R 2201/003* (2013.01); *H04R 2225/025* (2013.01); *H04R 2499/11* (2013.01)

(58) Field of Classification Search

CPC .... H04R 17/00; H04R 1/2842; H04R 1/2857; H04R 2201/003; H04R 2225/025; H04R 2499/11; H04R 25/48; H04R 25/65; H04R 7/04

USPC ..... 381/190

See application file for complete search history.

(56) References Cited

U.S. PATENT DOCUMENTS

| | | | | |
|---|---|---|---|---|
| 6,389,145 | B2 * | 5/2002 | Baumhauer, Jr. .... | H04R 1/2842 379/432 |
| 6,788,796 | B1 | 9/2004 | Miles | |
| 6,831,577 | B1 | 12/2004 | Furst | |
| 6,853,290 | B2 | 2/2005 | Jorgensen | |
| 6,859,542 | B2 | 2/2005 | Johannsen | |

(Continued)

FOREIGN PATENT DOCUMENTS

| | | |
|---|---|---|
| EP | 2750413 A1 | 7/2014 |
| EP | 3188503 A1 | 7/2015 |

OTHER PUBLICATIONS

Extended European Search Report for Application No. EP 18158547.2 dated Jun. 29, 2018 (4 pages).

*Primary Examiner* — Phylesha Dabney

(74) *Attorney, Agent, or Firm* — Nixon Peabody LLP

(57) ABSTRACT

A miniature speaker having at least a first and a second resonance in its frequency response. The miniature speaker includes a diaphragm for generating sound pressure waves in response to electrical drive signals, one or more sound channels at least partly surrounding a total air volume forming an acoustical mass, and one or more intermediate air volumes being acoustically connected to the one or more sound channels. The acoustical mass provides that the second resonance in the frequency response of the miniature speaker is positioned within an audible range.

20 Claims, 18 Drawing Sheets

(56) References Cited

U.S. PATENT DOCUMENTS

| | | | |
|---|---|---|---|
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doom |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 2010/0254556 | A1 | 10/2010 | Warren |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | Van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2017/0318383 | A1 | 11/2017 | Griffiths |

* cited by examiner

MINIATURE SPEAKER WITH ACOUSTICAL MASS

This application claims the benefit of European Patent Application No. 18158547.2, filed Feb. 26, 2018, which is incorporated herein by reference in its entirety.

FIELD OF THE INVENTION

The present invention relates to a miniature speaker or a miniature speaker assembly having a frequency response comprising a first and a second resonance, wherein the position of at least one of the resonances in the frequency response is at least partly determined by an acoustical mass.

BACKGROUND OF THE INVENTION

The frequency response of a traditional speaker for mobile audio devices, such as hearing aids or hearables, is typically determined by the moving mass in the speaker system. A traditional speaker may for example be a balanced armature receivers/speaker. The mechanical mass of such type of speaker is so large that a secondary resonance is sufficiently close to a main resonance whereby a useful extension of the bandwidth is achieved. However, the large mechanical mass is disadvantageous in that it may induce unwanted vibrations.

Speakers having a low moving mass, such as electrostatic and piezoelectric speakers/receivers, also tend to induce less vibrations. However, due to the low moving mass, the secondary resonance of for example a piezoelectric speaker/receiver is approximately 40 kHz which is unusable for extending the bandwidth because the gap between the main resonance and secondary resonance is way too big.

It may therefore be seen as an object of embodiments of the present invention to provide a miniature speaker comprising a low moving mass actuator being capable of generating sound in an audible bandwidth.

It may be seen as a further object of embodiments of the present invention to provide a miniature speaker having a frequency response comprising at least a first and a second resonance.

It may be seen as an even further object of embodiments of the present invention to provide a miniature speaker, wherein at least one of the resonances in the frequency response is, among other parameters, determined by an acoustical mass.

DESCRIPTION OF THE INVENTION

The above-mentioned object is complied with by providing, in a first aspect, a miniature speaker having at least a first and a second resonance in its frequency response, the miniature speaker comprising

- a diaphragm for generating sound pressure waves in response to electrical drive signals,
- one or more sound channels at least partly surrounding a total air volume forming an acoustical mass, and
- one or more intermediate air volumes being acoustically connected to the one or more sound channels, and acoustically connected to the diaphragm, wherein the acoustical mass provides that the second resonance in the frequency response of the miniature speaker is positioned within an audible range.

Thus, the present invention relates to a miniature speaker having a frequency response comprising a plurality of resonances, wherein the position of at least one of these resonances in the frequency response is determined by an acoustical mass associated with the miniature speaker. Thus, the presence of the acoustical mass is decisive for and therefore facilitates that the second resonance in the frequency response is positioned within an audible range. The miniature speaker may thus have a main and a secondary resonance in order to have a proper broadband response in the audible range.

The term "miniature speaker" should be understood as a speaker being suitable for being used in portable device, including hearing aids, hearing devices, hearables, tablets, cell phones etc. Thus, typical dimensions (height, width, depth) are smaller than 20 mm, such as smaller than 15 mm, such as smaller than 10 mm, such as smaller than 5 mm.

The diaphragm for generating sound pressure waves may preferably be a low-mass diaphragm. The diaphragm may comprise a substantially plane diaphragm in the form of a substantially flat diaphragm being adapted to move in response to an incoming electrical drive signal. A substantially flat diaphragm typically has a thickness being smaller than 0.5 mm, such as smaller than 0.2 mm, such as smaller than 0.1 mm, such as smaller than 0.05 mm. In one embodiment the substantially plane diaphragm may comprise a drive structure comprising a piezoelectric material layer arranged between a first and a second electrode. When an electrical drive signal is provided to the first and second electrodes the substantially plane diaphragm will move in response thereto due to deflections of the piezoelectric material. The piezoelectric material as well as the first and second electrodes may be integrated or embedded in the substantially plane diaphragm. An elastic layer may be secured to one of the electrodes.

In another embodiment the miniature speaker may further comprise an electrically conducting backplate arranged substantially parallel with a substantially plane diaphragm. The electrically conducting backplate may comprise one or more perforations in the form of a plurality of through-going openings. The substantially plane diaphragm may be an electrically conducting diaphragm and an electrical drive signal may thus be provided between the backplate and the diaphragm in order to move the substantially plane diaphragm in response thereto.

The first resonance of the miniature speaker may be within the range 1-5 kHz, such as in the range 2-4 kHz, such as in the range 3-4 kHz. The second resonance may be within the range 3-10 kHz, such as within the range 5-10 kHz, such as within the range 6-9 kHz.

The miniature speaker may further comprise one or more rear volumes. The one or more intermediate air volumes may have a total volume being smaller than 10%, such as smaller 5%, such as smaller than 3%, such as smaller than 2% of the volume of the one or more rear volume.

The one or more sound channels may have a predetermined cross-sectional area, S, and a predetermined length, L. With a mass density of air being denoted p, the acoustic mass, $M_a$, is given by $M_a=\rho \cdot L/S$. As an example, a miniature speaker having a diaphragm compliance of around 100 $m^3$/Pa would require an acoustic mass of approx. 60000 kg/m4 in order to bring the second resonance down to 7 kHz. Generally speaking, since the compliance of diaphragm is more or less proportional with the size of the rear volume (for efficient speakers), the acoustic mass is inversely proportional with the size of the rear volume.

The acoustical compliance of the one or more intermediate air volumes may advantageously be smaller than the acoustical compliance of the diaphragm. Moreover, a damping arrangement for damping the frequency response of the miniature speaker may be provided.

In a preferred embodiment of the miniature speaker the diaphragm may form part of a MEMS die, and the one or more intermediate air volumes is/are at least partly defined between the diaphragm, a MEMS bulk and a substrate. As disclosed above the diaphragm may be implemented as a substantially plane diaphragm of the type disclosed above, i.e. in the form of a piezoelectric diaphragm or an electrostatic diaphragm. Moreover, the one or more sound channels may at least partly be defined in the substrate of the MEMS die. In the present context the term "at least partly" should be understood as fully integrated in the substrate or defined by the substrate in combination with other elements, including top and/or bottom plates. Also, the one or more sound channels may be defined as a number of perturbations, such as in the form of through-going openings, in the substrate.

In a second aspect the present invention relates to a miniature speaker having at least a first and a second resonance in its frequency response, the miniature speaker comprising

- a low-mass motor for generating sound pressure waves in response to electrical drive signals,
- one or more sound channels at least partly surrounding a total air volume forming an acoustical mass, and
- one or more intermediate air volumes being acoustically connected to the one or more sound channels, and acoustically connected to the diaphragm, wherein the acoustical mass provides that the second resonance in the frequency response of the miniature speaker is positioned within an audible range.

The present invention thus relates to a miniature speaker having a frequency response comprising a plurality of resonances, wherein the position of at least one of these resonances in the frequency response is determined by an acoustical mass associated with the miniature speaker. Thus, the presence of the acoustical mass is decisive for and therefore facilitates that the second resonance in the frequency response is positioned within an audible range. The miniature speaker may thus have a main and a secondary resonance in order to have a proper broadband response in the audible range.

A low-mass motor involves a motor having a lower moveable mass compared to for example moving armature type motors. An unmodified low-mass motor is acoustically distinct in that its system/natural resonance typical falls outside the audible range. Thus, in order for low-mass speakers to be usable in for example hearing aid they need to be modified as proposed above.

The low-mass motor of the second aspect may be implemented as disclosed in connection with the first aspect of the present invention. Thus, the low-lass motor may comprise a substantially plane diaphragm in the form of a substantially flat structure being adapted to move in response to an incoming electrical drive signal.

The substantially plane diaphragm may comprise a drive structure comprising a piezoelectric material layer arranged between a first and a second electrode. When an electrical drive signal is provided to the first and second electrodes the substantially plane diaphragm will move in response thereto due to deflections of the piezoelectric material. The piezoelectric material as well as the first and second electrodes may be integrated or embedded in the substantially plane diaphragm. An elastic layer may be secured to one of the electrodes.

Alternatively, the low-mass motor may comprise an electrically conducting backplate arranged substantially parallel with a substantially plane diaphragm. The electrically conducting backplate may comprise one or more perforations in the form of a plurality of through-going openings. The substantially plane diaphragm may be an electrically conducting diaphragm and an electrical drive signal may thus be provided between the backplate and the diaphragm in order to move the substantially plane diaphragm in response thereto.

The implementations of the one or more sound channels and the one or more intermediate air volumes may be as discussed in connection with the first aspect of the present invention.

In a third aspect the present invention relates to a miniature speaker assembly comprising a plurality of miniature speakers according to any of the preceding claims. The number of miniature speakers involved may in principle be arbitrary. Thus, the number of miniature speakers may be 2, 3, 4, 5 or even more miniature speakers. Moreover, the plurality of miniature speakers may be arranged relative to each other in various ways, including beside each other, above each other, displaced relative to each other, rotated relative to each other etc.

In a fourth aspect the present invention relates to an in-ear piece for a hearing device, said in-ear piece comprising a miniature speaker according to the first, second or third aspects of the present invention.

In a fifth aspect the present invention relates to a hearing device comprising an in-ear piece according to the fourth aspect of the present invention.

In general the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

The present invention will now be described in further details with reference to the accompanying figures, wherein.

Figure 1:
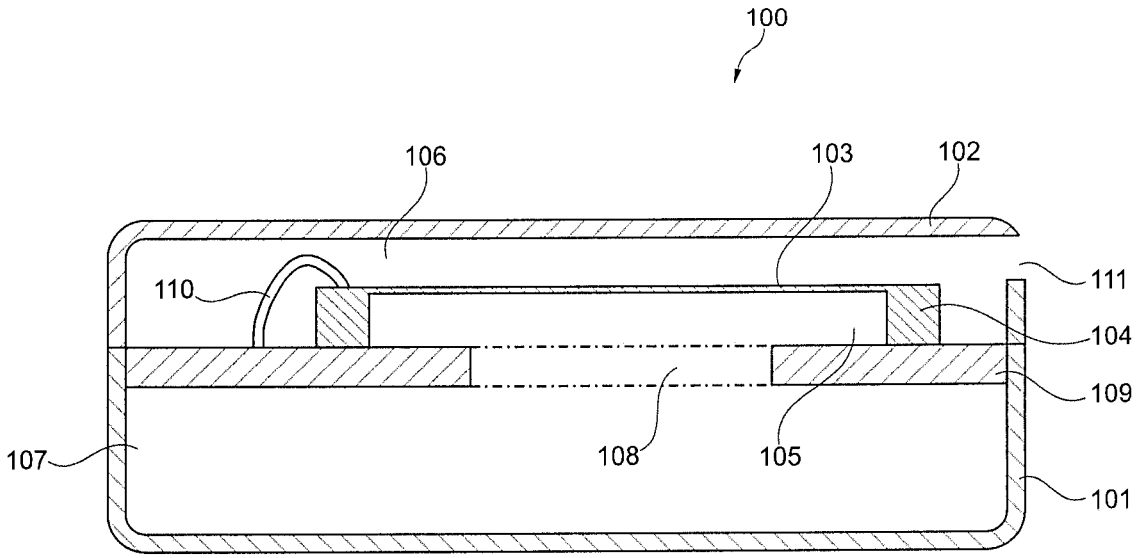
FIG. 1 shows a miniature speaker.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In a general aspect the present invention relates to a miniature speaker having a frequency response comprising a plurality of resonances, wherein the position of at least one of these resonances in the frequency response is determined by an acoustical mass associated with the miniature speaker.

Referring now to FIG. 1 a miniature speaker 100 is depicted. The miniature speaker 100 comprises a speaker housing comprising a lower part 101 and a cover 102 having a sound outlet port 111 arranged therein. Within the speaker housing a substrate 109 comprising an opening 108 is provided. The opening 108 forms a sound channel through the substrate 109, and the total air volume of the opening 108 forms an acoustical mass. Together with the diaphragm 103 and the MEMS bulk 104 the substrate 109 separates a front volume 106 from a rear volume 107. The front volume 106 is acoustically connected to the sound outlet port 111. One or more electrical wires 110 ensure that electrical signal may be led to the diaphragm 103 in order to move said diaphragm 103 so as to generate sound pressure waves. The substrate 109 can be made out of an electrically insulated layer and a patterned conductive layer and provide means to connect to an external electrical signal source. As seen in FIG. 1 the diaphragm 103, the MEMS die 104 and the substrate 109 define a MEMS cavity 105 in the form of an intermediate volume between the diaphragm 103 and the opening 108.

Figure 2:
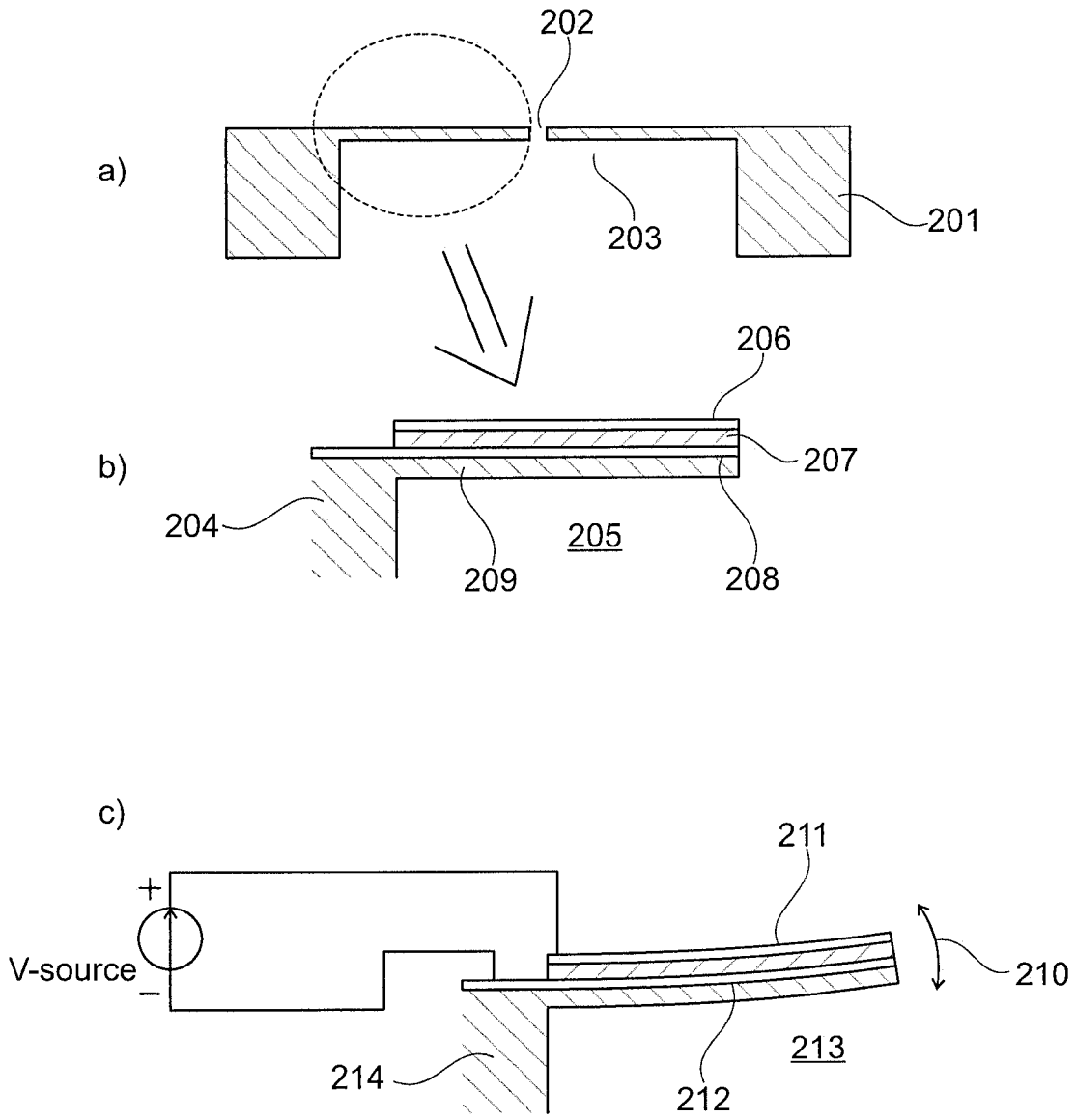
FIG. 2 shows a diaphragm composed by piezoelectric levers.
Figure 3:
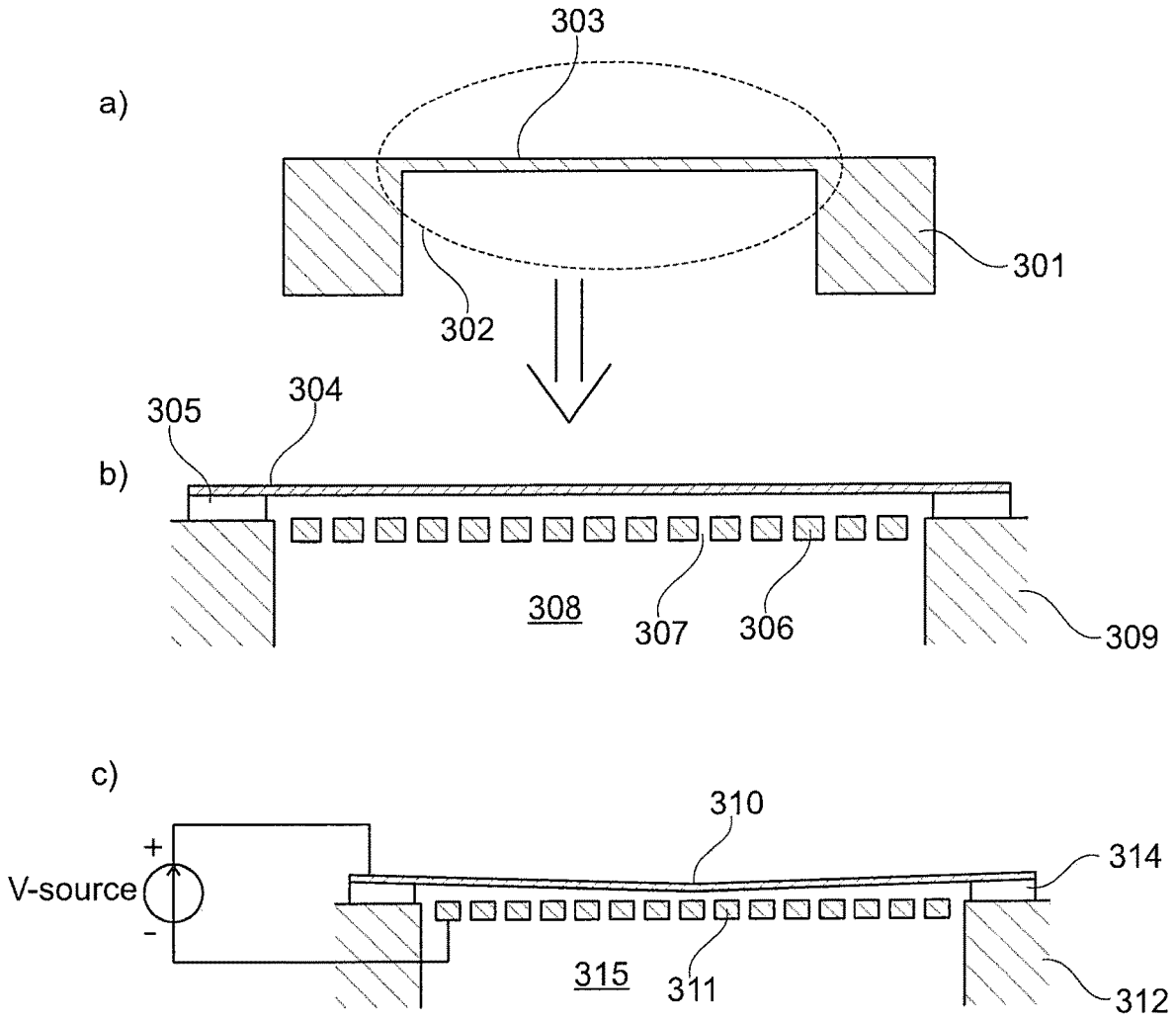
FIG. 3 shows an electrostatic diaphragm and an associated backplate.

As depicted in FIG. 2 the diaphragm may be a piezoelectric diaphragm, or it may be implemented as an electrostatic diaphragm having an associated backplate as depicted in FIG. 3.

In the embodiment shown in FIG. 2 piezoelectric levers 203 forming a diaphragm are depicted. The piezoelectric levers are secured to a MEMS bulk 201. Moreover, an opening or gap 202 is provided in the centre portion, cf. FIG. 2*a*. The gaps between the levers are so narrow that the acoustic leakage through the gaps is not affecting the acoustic output in the audible frequency range, and the plurality of levers effectively behave as a sealed diaphragm. The acoustic leakage trough the gaps determines the low frequency corner of the acoustic output of the speaker. The low frequency corner may be higher than 10 Hz, such as higher than 20 Hz, such as higher than 30 Hz, such as higher than 40 Hz, such as higher than 50 Hz. The gap 202 may be smaller than 20 μm, such as smaller than 10 μm, such as smaller than 5 μm. FIG. 2*b* shows an enlarged view of the encircled portion of FIG. 2*a*. As depicted in FIG. 2*b* the piezoelectric lever forms a layered structure comprising a piezoelectric material 207 arranged between two electrodes 206, 208. The electrodes 206, 208 are adapted to be connected to a voltage source, cf. FIG. 2*c*. An elastic layer 209 is secured to the electrode 208. The elastic layer 209 is integrated with the MEMS bulk 204 and defines a MEMS cavity 205 in combination therewith. The MEMS cavity 205 forms an intermediate volume. FIG. 2*c* shows the piezoelectric lever in a deflected position as indicated by the arrow 210. The deflection of the piezoelectric levers is provided by applying a voltage to the electrodes 211, 212 whereby the levers deflect either up or down depending of the polarity of the applied voltage. Again, the MEMS cavity 213, which forms an intermediate volume, is provided below the levers. Since the gaps between the levers are so narrow that the levers behave as a diaphragm for the audible frequency range, a sound pressure can be generated when an appropriate drive signal/voltage applied to the electrodes 211, 212.

Alternatively, if a diaphragm is secured to the piezoelectric lever and an appropriate drive signal/voltage applied to the electrodes 211, 212 sound pressure variations may be generated. Such a separate diaphragm may be a polymer diaphragm, a metal diaphragm or a composite, and can be comprised of rigid regions and compliant regions.

In FIG. 3 an electrostatically actuated diaphragm having an associated backplate is depicted. With reference to FIG. 3*a* an electrically conducting diaphragm 303, a MEMS bulk 301 and a MEMS cavity 302 are depicted. FIG. 3*b* shows an enlarged version of FIG. 3*a*. As seen in FIG. 3*b* the diaphragm 304 is arranged on a spacer 305 so that a distance to a backplate 306 with perforations 307 is ensured. The diaphragm 304, the spacer 305 and the backplate 306 form in combination an intermediate volume. Each of the perforations 307 forms a sound channel through the backplate 306, and the total air volume of the perforations 307 forms an acoustical mass.

The MEMS bulk 309, which supports the diaphragm 304 and the spacer 305, defines in combination with the backplate 306, the MEMS cavity 308. In FIG. 3*c* a voltage source has been connected to the electrically conducting diaphragm 310 and the perforated backplate 311 above the MEMS cavity 315. As depicted in FIG. 3*c* the applied voltage causes the diaphragm 310 to deflect in the direction of the backplate 311. With an appropriate drive signal/voltage applied between the diaphragm 310 and the perforated backplate 311 sound pressure variations may be generated. As previously mentioned the diaphragm 310 is supported by the MEMS bulk 312 via the spacer 314.

Figure 4:
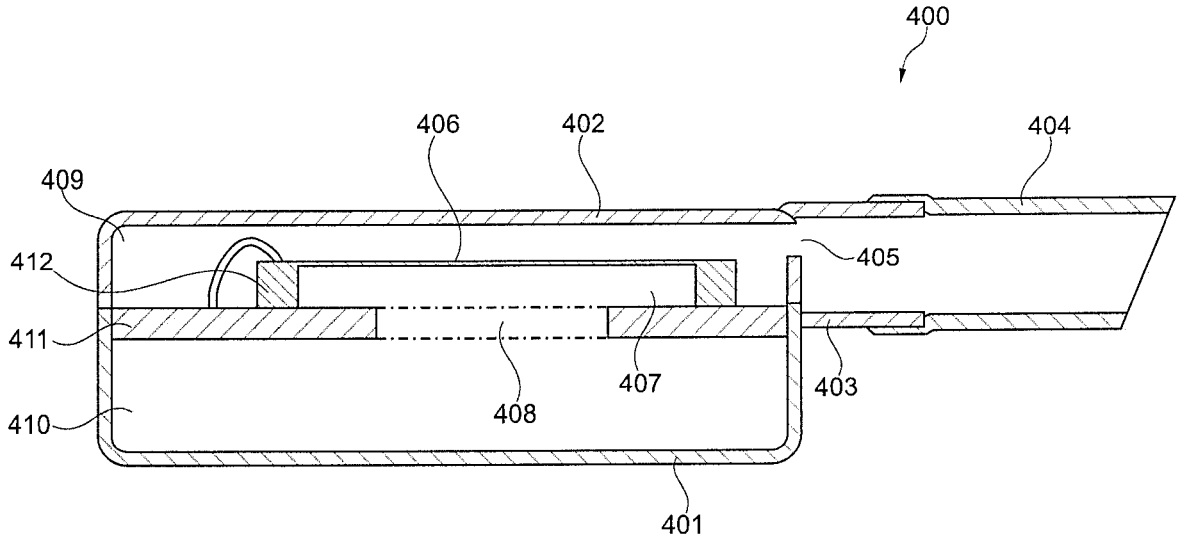
FIG. 4 shows a miniature speaker having an external tube section for defining the main resonance.

FIG. 4 shows a miniature speaker 400 having a rigid tube 403 and a flexible tube 404 in connection with the sound outlet port 405. The miniature speaker 400 comprises a speaker housing comprising a lower part 401 and a cover 402 having the sound outlet port 405 arranged therein. Within the speaker housing a substrate 411 comprising an opening 408 is provided. The opening 408 forms a sound channel through the substrate 411, and the total air volume of the opening 408 forms an acoustical mass. Together with the diaphragm 406 and the MEMS bulk 412 the substrate 411 separates a front volume 409 from a rear volume 410. The front volume 409 is acoustically connected to the sound outlet port 405. An electrical wire ensures that electrical signals may be led to the diaphragm 406 in order to move said diaphragm 406 so as to generate sound pressure waves. The diaphragm 406 may be driven by piezoelectric levers, cf. FIG. 2, or it may be implemented as an electrostatic diaphragm having an associated backplate, cf. FIG. 3. The diaphragm 406, the MEMS bulk 412 and the substrate 411 define a MEMS cavity 407 in the form of an intermediate volume between the diaphragm 406 and the opening 408.

The miniature speaker shown in FIG. 4 has a frequency response that comprises a main resonance. The position of the main resonance in the frequency response is determined by the acoustical masses and compliances in the system. Since the moving mass of the diaphragm is relatively small, the total acoustical mass is dominated by the acoustical mass of the air volume within the tube sections 403, 404. Typically, the miniature speaker shown in FIG. 4 has a main resonance within the range 2-4 kHz The total frequency response of the miniature speaker is typically within the range 1-10 kHz.

Figure 5:
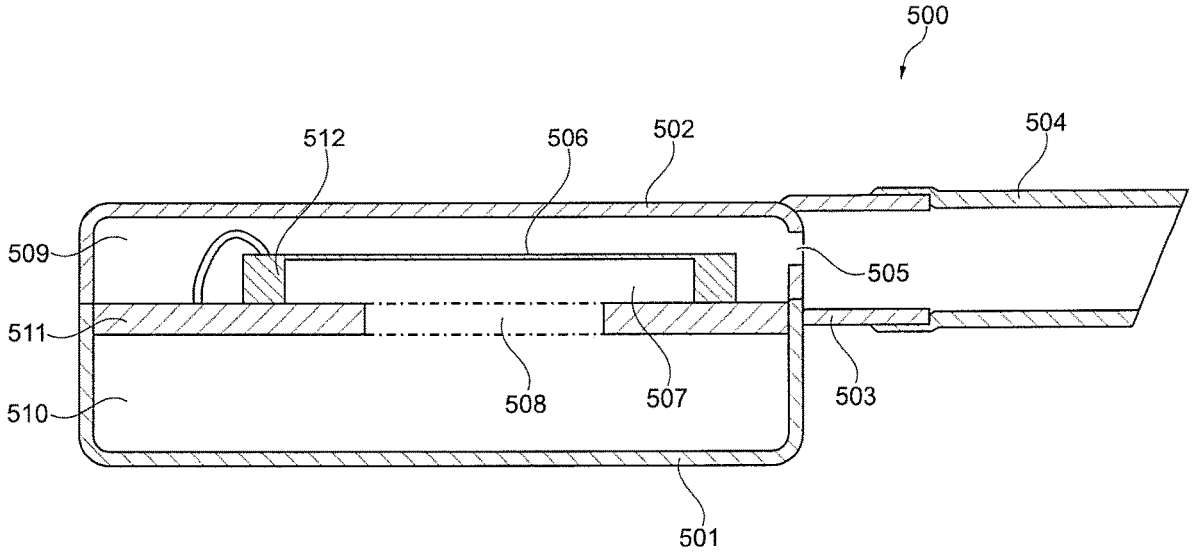
FIG. 5 shows a miniature speaker having an external tube section and a sound outlet port defining the main resonance.

FIG. 5 shows a miniature speaker 500 also having a rigid tube 503 and a flexible tube 504 in connection with the sound outlet port 505 which comprises an acoustic aperture which determined the acoustic mass of the miniature speaker. Similar to the embodiment shown in FIG. 4 the miniature speaker 500 comprises a speaker housing comprising a lower part 501 and a cover 502 having the sound outlet port 505 arranged therein. Within the speaker housing a substrate 511 comprising an opening 508 is provided. The opening 508 forms a sound channel through the substrate 511, and the total air volume of the opening 508 forms an acoustical mass. Together with the diaphragm 506 and the MEMS bulk 512 the substrate 511 separates a front volume 509 from a rear volume 510. The front volume 509 is acoustically connected to the sound outlet port 505 which comprises the acoustic aperture which determined the acoustic mass of the miniature speaker. An electrical wire ensures that electrical signals may be led to the diaphragm 506 so that sound pressure waves may be generated in response thereto. Again, the diaphragm 506 may be driven by piezoelectric levers, cf. FIG. 2, or it may be implemented as an electrostatic diaphragm having an associated backplate, cf. FIG. 3. The diaphragm 506, the MEMS bulk 512 and the substrate 511 define a MEMS cavity 507 in the form of an intermediate volume between the diaphragm 506 and the opening 508.

Similar to the embodiment shown in FIG. 4, the embodiment shown in FIG. 5 has a frequency response that comprises a main resonance. The position of the main resonance in the frequency response is determined by an acoustical mass of the air volume of the acoustic aperture arranged in the sound outlet port 505. Typically, the miniature speaker shown in FIG. 5 has a main resonance within the range 2-4 kHz. Similar to the embodiment shown in FIG. 4 the total frequency response of the miniature speaker is typically within the range 1-10 kHz.

Figure 6:
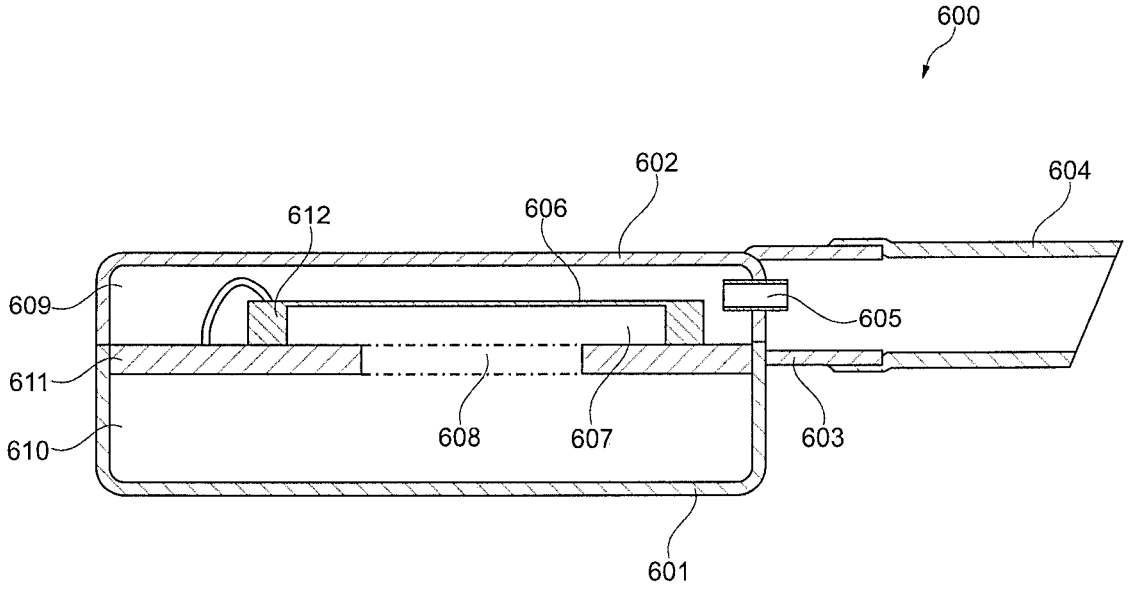
FIG. 6 shows a miniature speaker having an external tube section and a sound outlet tube defining the main resonance.

Turning now to FIG. 6 a tube 605 defining an air volume and thereby an acoustical mass has been inserted in the sound outlet port. With the exception of the tube 605 the miniature speaker shown in FIG. 6 is similar to the embodiments shown in FIGS. 4 and 5. Thus, the embodiment shown in FIG. 6 comprises a speaker housing comprising a lower part 601 and a cover 602 having the tube 605 secured thereto. On the outside of the speaker housing a rigid tube 603 and a flexible tube 604 are provided. Within the speaker housing a substrate 611 having opening 608, a diaphragm 606 and a MEMS bulk 612 are provided. The opening 608 forms a sound channel through the substrate 611, and the total air volume of the opening 608 forms an acoustical mass. Together with the diaphragm 606 and the MEMS bulk 612 the substrate 611 separates a front volume 609 from a rear volume 610. The diaphragm 606 may, as previously addressed, be driven by piezoelectric levers, cf. FIG. 2, or it may be implemented as an electrostatic diaphragm having an associated backplate, cf. FIG. 3. The diaphragm 606, the MEMS bulk 612 and the substrate 611 define a MEMS cavity 607 in the form of an intermediate volume between the diaphragm 606 and the opening 608. Similar to the previous embodiments, the embodiment shown in FIG. 6 has a frequency response comprising a main resonance where the position of the main resonance in the frequency response is determined by an acoustical mass of the air volume of the tube 605. The miniature speaker shown in FIG. 6 typically has a main resonance within the range 2-4. The total frequency response of the miniature speaker is typically within the range 1-10 kHz.

Figure 7:
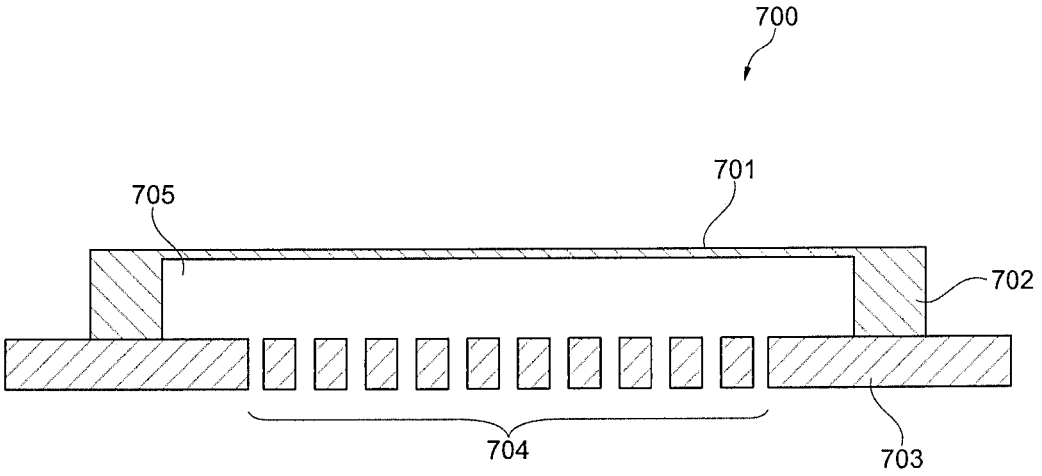
FIG. 7 shows a perforated substrate defining the acoustical mass.

Referring now to FIG. 7 an embodiment 700 where the acoustical mass is defined by the total air volume of a plurality of perforations 704 in the substrate 703 is depicted. As seen in FIG. 7 the diaphragm 701, the MEMS bulk 702 and the perforated substrate 703, 704 define an intermediate volume 705. The diaphragm 701 may, as previously addressed, be driven by piezoelectric levers, cf. FIG. 2, or it may be implemented as an electrostatic diaphragm having an associated backplate, cf. FIG. 3.

Figure 8:
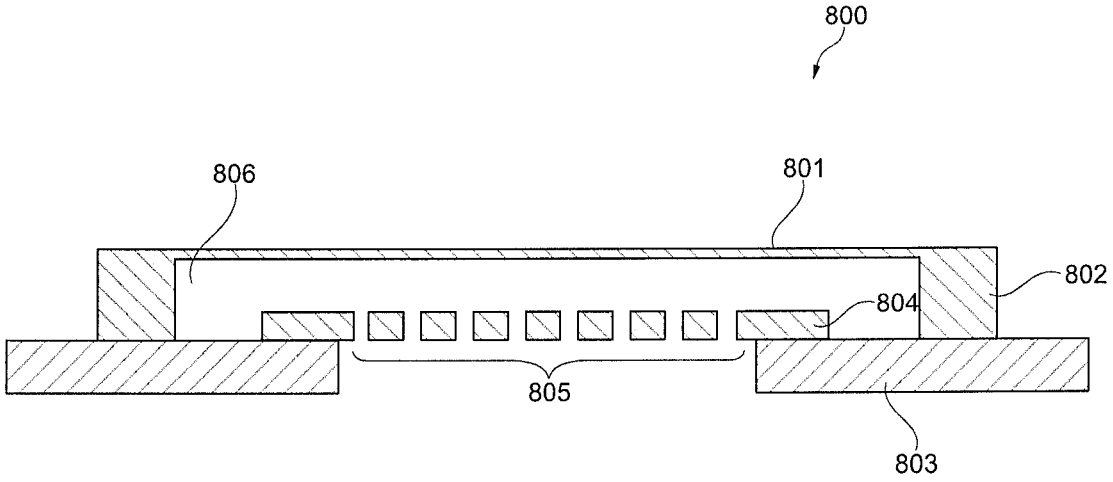
FIG. 8 shows a perforated plate defining the acoustical mass.

FIG. 8 shows an almost similar embodiment 800 where the acoustical mass is defined by the total air volume of a plurality of perforations 805 in the plate 804 which is supported by the substrate 803. As seen in FIG. 8 the diaphragm 801, the MEMS bulk 802, the perforated plate 804, 805, and the substrate 803 define an intermediate volume 806. The diaphragm 801 may, as previously addressed, be driven by piezoelectric levers, cf. FIG. 2, or it may be implemented as an electrostatic diaphragm having an associated backplate, cf. FIG. 3.

Figure 9:
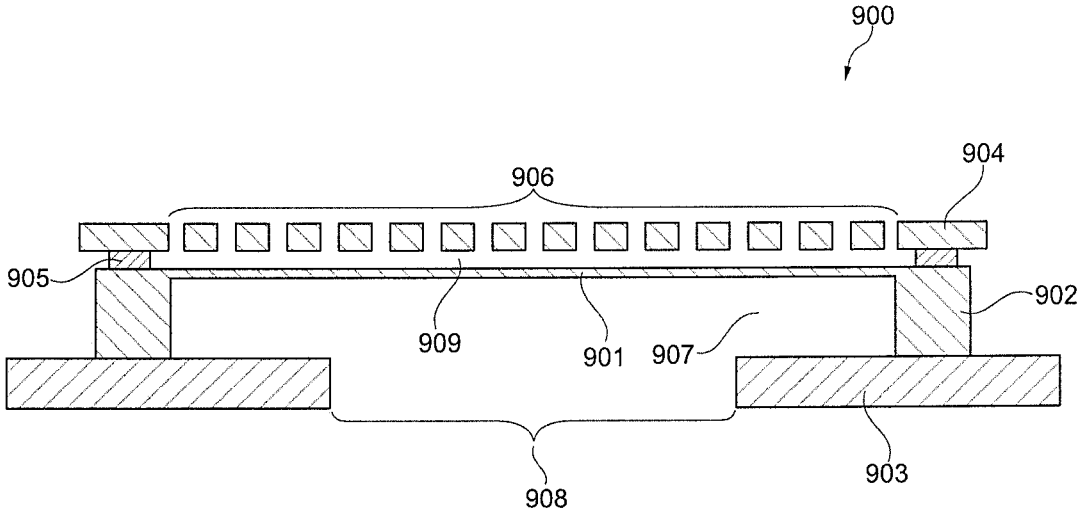
FIG. 9 shows a perforated upper plate defining the acoustical mass, FIG. 10 also shows a perforated upper plate defining the acoustical mass.

FIG. 9 shows yet another embodiment 900 where the acoustical mass is defined by the total air volume of a plurality of perforations 906 in the plate 904 which is arranged above the diaphragm 901. The perforated plate 904 and the diaphragm 91 are separated by the spacer 905 so that an intermediate volume 909 is formed therebetween. As seen in FIG. 9 the diaphragm 901, the MEMS bulk 902, and the substrate 903 define having an opening 908 define a MEMS cavity 907. Similar to the previous embodiments the diaphragm 901 may, as previously addressed, be driven by piezoelectric levers, cf. FIG. 2, or it may be implemented as an electrostatic diaphragm having an associated backplate, cf. FIG. 3.

Figure 10:
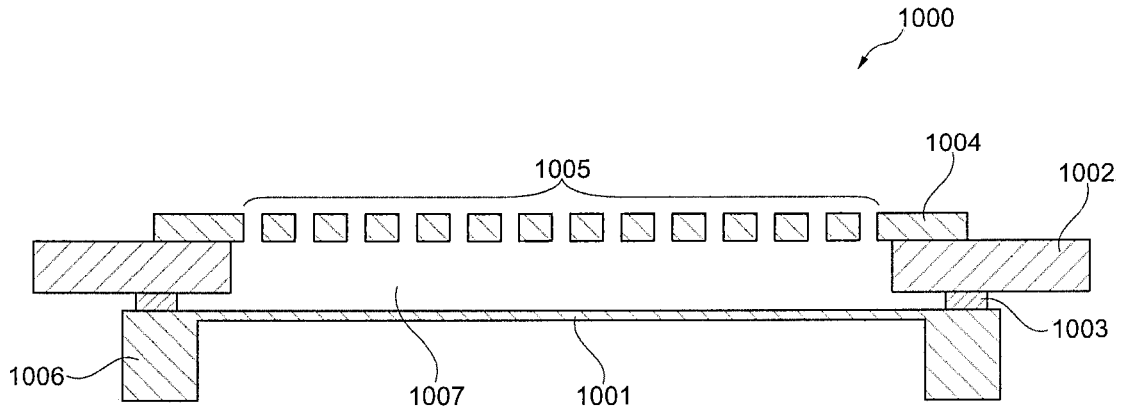

FIG. 10 shows yet another embodiment 1000 where the acoustical mass is defined by the total air volume of a plurality of perforations 1005 in the plate 1004 which is supported by the substrate 1002. The perforated plate 1004 and the diaphragm 1001 are separated by the substrate 1002 and the spacer 1003 so that an intermediate volume 1007 is formed therebetween. Similar to the previous embodiments the diaphragm 1001, which is supported by the MEMS bulk 1006, may be driven by piezoelectric levers, cf. FIG. 2, or it may be implemented as an electrostatic diaphragm having an associated backplate, cf. FIG. 3.

Figure 11:
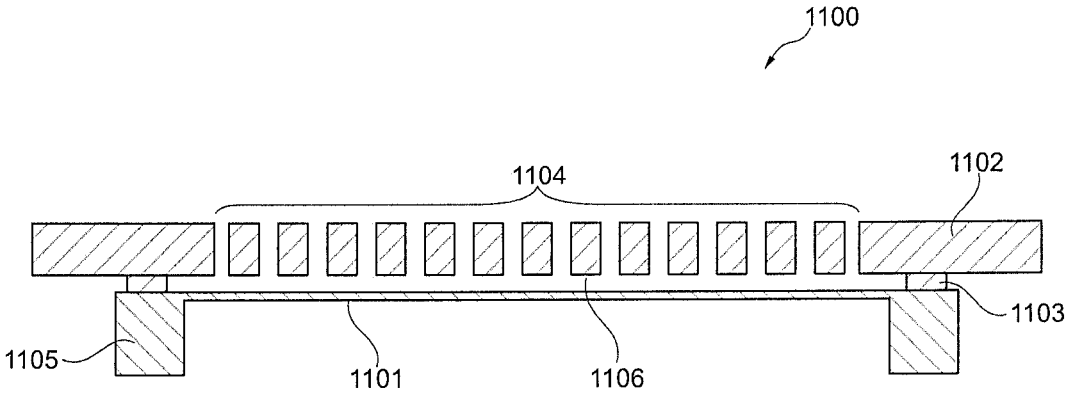
FIG. 11 shows a perforated substrate defining the acoustical mass.

FIG. 11 shows an embodiment 1100 where the acoustical mass is defined by the total air volume of the openings 1104 of a perforated substrate 1102 arranged on a spacer 1103 in order to form an intermediate volume 1106 between the perforated substrate 1102 and the membrane 1101 which is supported by the MEMS bulk 1105. The diaphragm 1101 may be driven by piezoelectric levers, cf. FIG. 2, or it may be implemented as an electrostatic diaphragm having an associated backplate, cf. FIG. 3.

Figure 12:
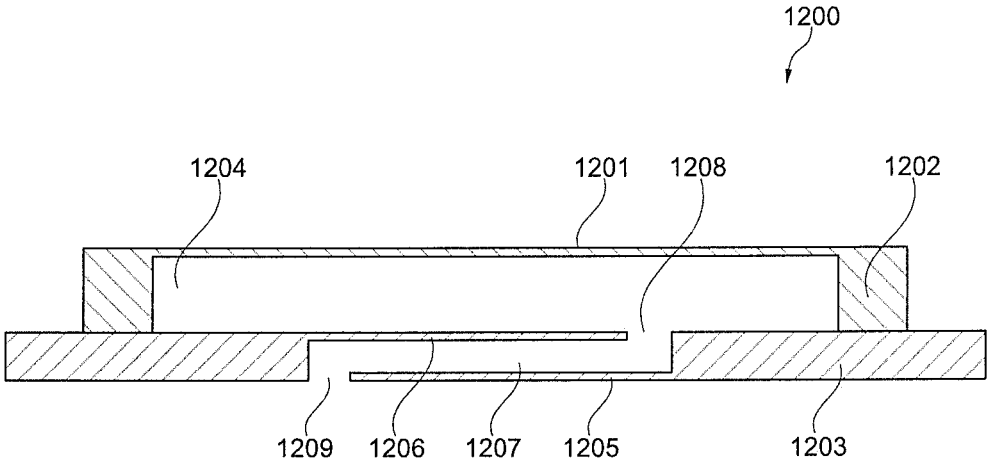
FIG. 12 shows an integrated sound channel defining the acoustical mass.

FIG. 12 shows an embodiment 1200 where the acoustical mass is defined by the air volume in the sound channel 1207 having sound inlet 1208 and sound outlet 1209. The sound channel 1207 is defined between the upper wall 1206 and the lower wall 1205 and it forms an integral part of the substrate 1203. An intermediate volume 1204 is formed between the diaphragm 1201, the MEMS bulk 1202 and the substrate 1203. The diaphragm 1201 may as previously addressed be driven by piezoelectric levers, cf. FIG. 2, or it may be implemented as an electrostatic diaphragm having an associated backplate, cf. FIG. 3.

Figure 13:
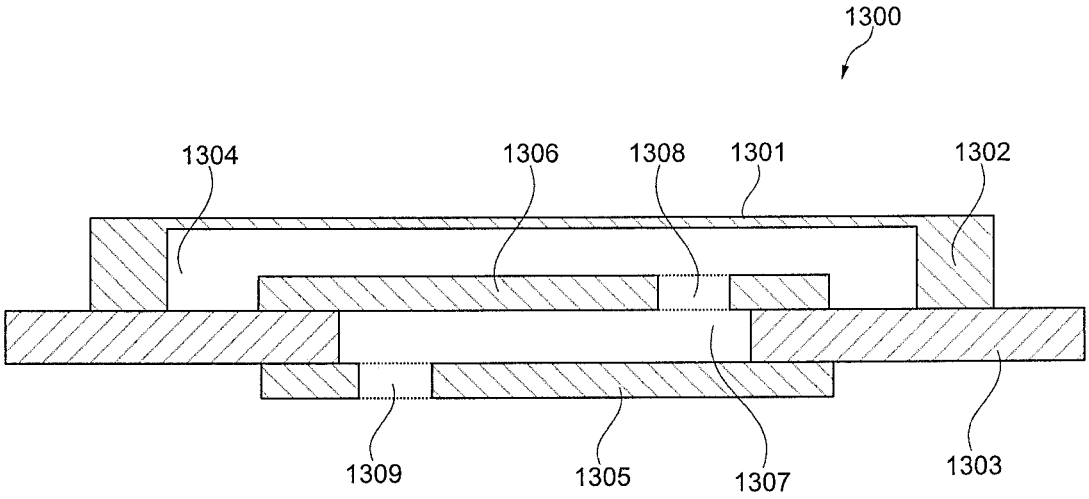
FIG. 13 shows a non-integrated sound channel defining the acoustical mass.

FIG. 13 shows an embodiment 1300 similar to the one shown in FIG. 12. In FIG. 13 the acoustical mass is defined by the air volume in the sound channel 1307 having sound inlet 1308 and sound outlet 1309. The sound channel 1307 is defined between the upper and lower plates 1306, 1305 which are secured to the substrate 1303. An intermediate volume 1304 is formed between the diaphragm 1301, the MEMS bulk 1302, the upper plate 1306, and the substrate 1303. The diaphragm 1301 may as previously addressed be driven by piezoelectric levers, cf. FIG. 2, or it may be implemented as an electrostatic diaphragm having an associated backplate, cf. FIG. 3.

Figure 14:
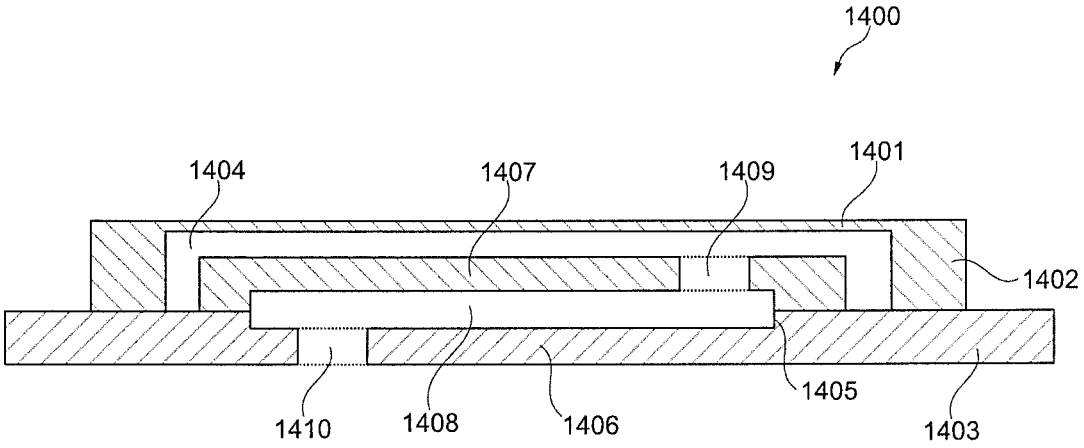
FIG. 14 shows a partly integrated sound channel defining the acoustical mass.

FIG. 14 shows yet another embodiment 1400 wherein the acoustical mass is defined by the air volume in the sound channel 1408 having sound inlet 1409 and sound outlet 1410. The sound channel 1408 is defined between the upper plate 1407 and a thinned portion 1406 of the substrate 1403. As seen in FIG. 14 the thinned portion 1406 is formed as a recess or an indentation 1405 in the substrate. The upper plate 1407 is secured to the substrate 1403. An intermediate volume 1404 is formed between the diaphragm 1401, the MEMS bulk 1402, the upper plate 1407, and the substrate 1403. The diaphragm 1401 may as previously addressed be driven by piezoelectric levers, cf. FIG. 2, or it may be implemented as an electrostatic diaphragm having an associated backplate, cf. FIG. 3.

The acoustical masses of the embodiments shown in FIGS. 12-14 all provide a certain amount of damping.

In the embodiments depicted in FIGS. 12-14 the sound channels are implemented in connection with the substrate. It should however be noted that the sound channels may alternatively be implemented outside the substrate, for example in a way similar to the perforated plate in FIG. 9.

Figure 15:
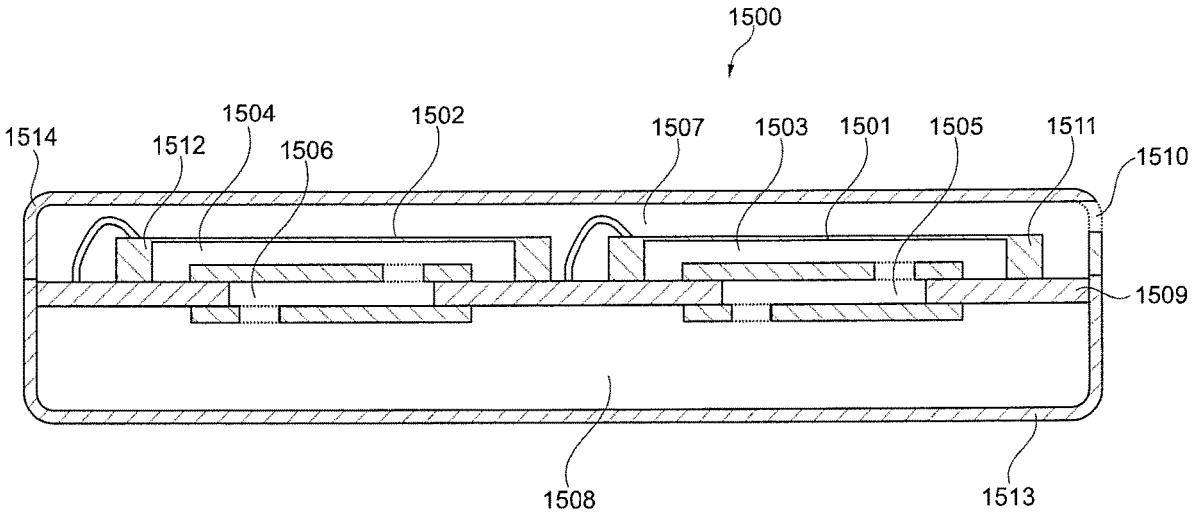
FIG. 15 shows a first miniature speaker assembly.

FIG. 15 shows a miniature speaker assembly 1500 comprising two miniature speakers of the type shown in FIG. 13. The two miniature speakers are arranged side-by-side within a speaker housing comprising a lower part 1513 and a cover 1514. The acoustical mass of each speaker is defined by the air volume in the respective sound channels 1505, 1506 each having sound inlet and a sound outlet. The sound outlets are acoustically connected to a common rear volume 1508. The sound channels 1505, 1506 are both defined between respective upper and lower plates which are secured to the common substrate 1509.

Referring now to the left speaker in FIG. 15 an intermediate volume 1504 is formed between the diaphragm 1502, the MEMS bulk 1512, the upper plate of the sound channel, and the common substrate 1509. Referring now to the right speaker in FIG. 15 an intermediate volume 1503 is formed between the diaphragm 1501, the MEMS bulk 1511, the upper plate of the sound channel, and the common substrate 1509. Moreover, the miniature speaker assembly shown in FIG. 15 comprises a common front volume 1507, which is acoustically connected to the sound outlet port 1510, and a common rear volume 1508. The diaphragms 1501, 1502 may as previously addressed be driven by piezoelectric levers, cf. FIG. 2, or it may be implemented as an electrostatic diaphragm having an associated backplate, cf. FIG. 3. Preferably, the two miniature speakers of the assembly shown in FIG. 15 are identical. It should however be noted that they may in fact be different.

Figure 16:
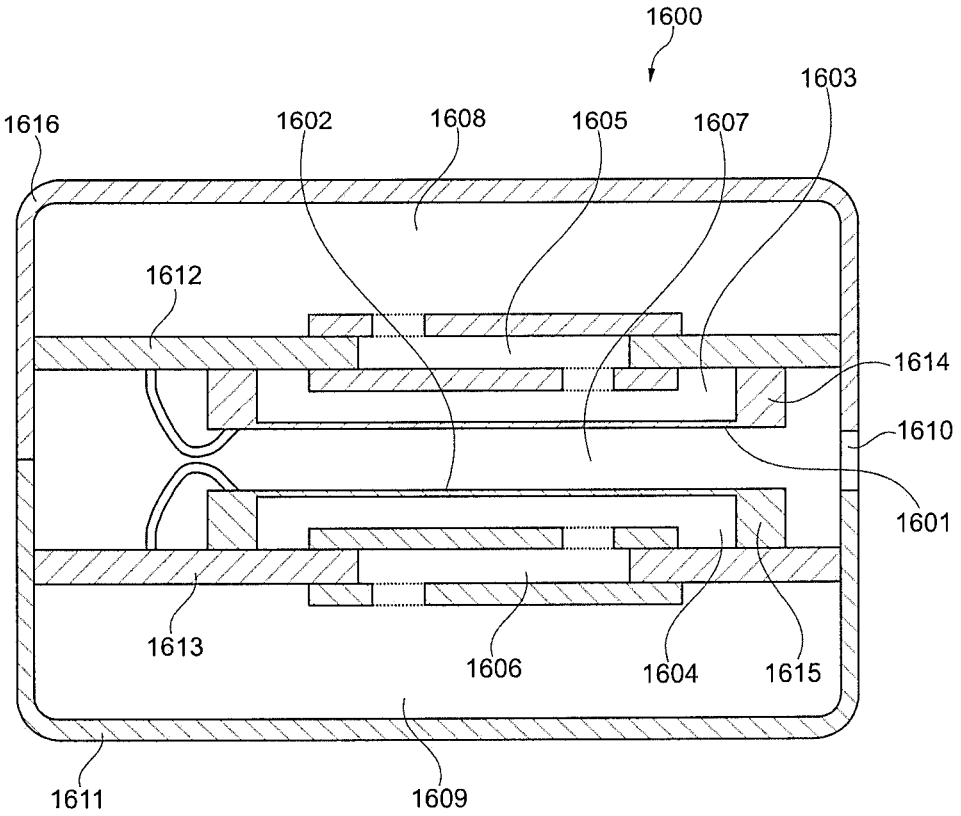
FIG. 16 shows a second miniature speaker assembly.

FIG. 16 shows a miniature speaker assembly 1600 also comprising two miniature speakers of the type shown in FIG. 13. In FIG. 16 the two miniature speakers are arranged above each other within a speaker housing comprising a lower part 1611 and an upper part 1616. Similar to the embodiment shown in FIG. 15 the acoustical mass of each speaker is defined by the air volume in the respective sound channels 1605, 1606 each having sound inlet and a sound outlet. The sound outlets are acoustically connected to respective rear volumes 1608, 1609. The sound channels 1605, 1606 are both defined between respective upper and lower plates which are secured to respective substrates 1612, 1613. Referring now to the upper speaker in FIG. 16 an intermediate volume 1603 is formed between the diaphragm 1601, the MEMS bulk 1614, the lower plate of the sound channel, and the substrate 1612. Referring now to the lower speaker in FIG. 16 an intermediate volume 1604 is formed between the diaphragm 1602, the MEMS bulk 1615, the upper plate of the sound channel, and the substrate 1613. Moreover, the miniature speaker assembly shown in FIG. 16 comprises a common front volume 1607, which is acoustically connected to the sound outlet port 1610, and respective rear volumes 1608, 1609. Again, the diaphragms 1601, 1602 may be driven by piezoelectric levers, cf. FIG. 2, or it may be implemented as an electrostatic diaphragm having an associated backplate, cf. FIG. 3. Preferably, the two miniature speakers of the assembly shown in FIG. 16 are identical. It should however be noted that they may in fact be different.

Figure 17:
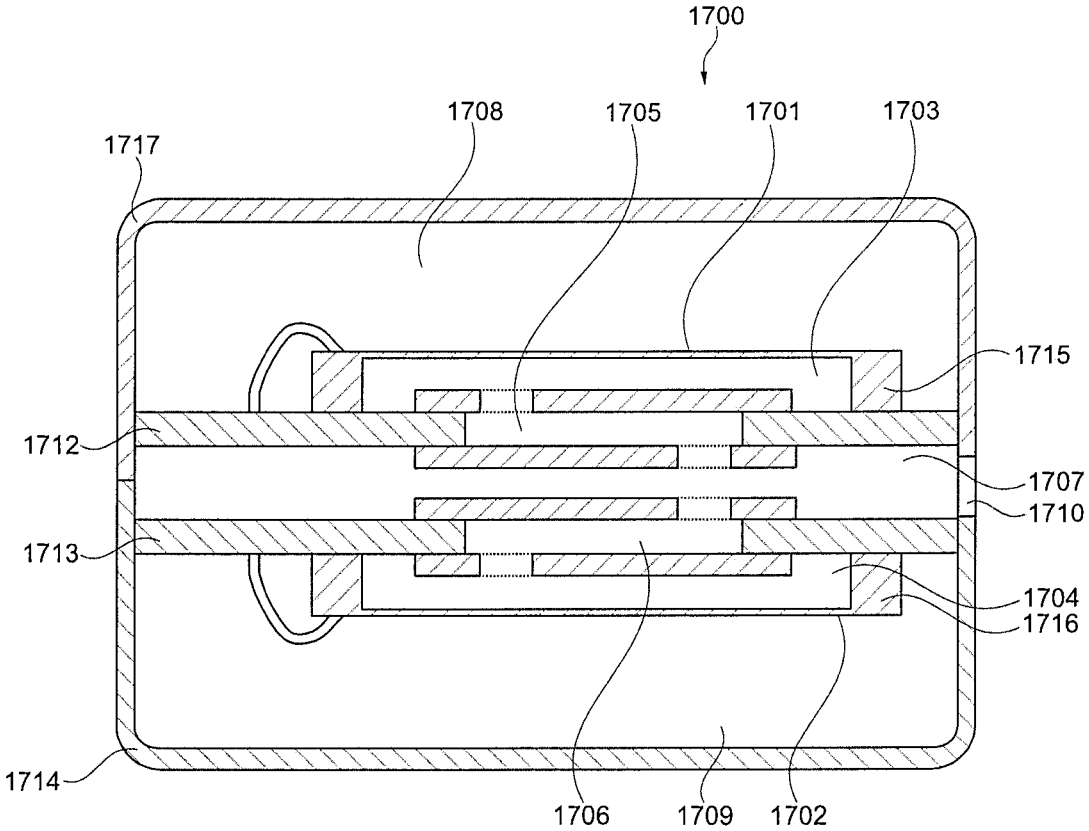
FIG. 17 shows a third miniature speaker assembly.

FIG. 17 shows yet another miniature speaker assembly 1700 still comprising two stacked miniature speakers of the type shown in FIG. 13. In FIG. 17 the two miniature speakers are arranged within a speaker housing comprising a lower part 1714 and an upper part 1717. Compared to the embodiment shown in FIG. 16 the miniature speakers shown in FIG. 17 are flipped up-side down. The acoustical mass of each miniature speaker is defined by the air volume in the respective sound channels 1705, 1706 each having sound inlet and a sound outlet. As shown in FIG. 17 the sound outlets are acoustically connected to a common front volume 1707 which is acoustically connected to the sound outlet port 1710. The sound channels 1705, 1706 are both defined between respective upper and lower plates which are secured to respective substrates 1712, 1713. Referring now to the upper speaker in FIG. 17 an intermediate volume 1703 is formed between the diaphragm 1701, the MEMS bulk 1715, the upper plate of the sound channel, and the substrate 1712. Referring now to the lower speaker in FIG. 17 an intermediate volume 1704 is formed between the diaphragm 1702, the MEMS bulk 1716, the upper plate of the sound channel, and the substrate 1713. Moreover, the miniature speaker assembly shown in FIG. 17 comprises a common front volume 1707, which is acoustically connected to the sound outlet port 1710, and respective rear volumes 1708, 1709. Again, the diaphragms 1701, 1702 may be driven by piezoelectric levers, cf. FIG. 2, or it may be implemented as an electrostatic diaphragm having an associated backplate, cf. FIG. 3. Preferably, the two miniature speakers of the assembly shown in FIG. 17 are identical. It should however be noted that they may in fact be different.

Figure 18:
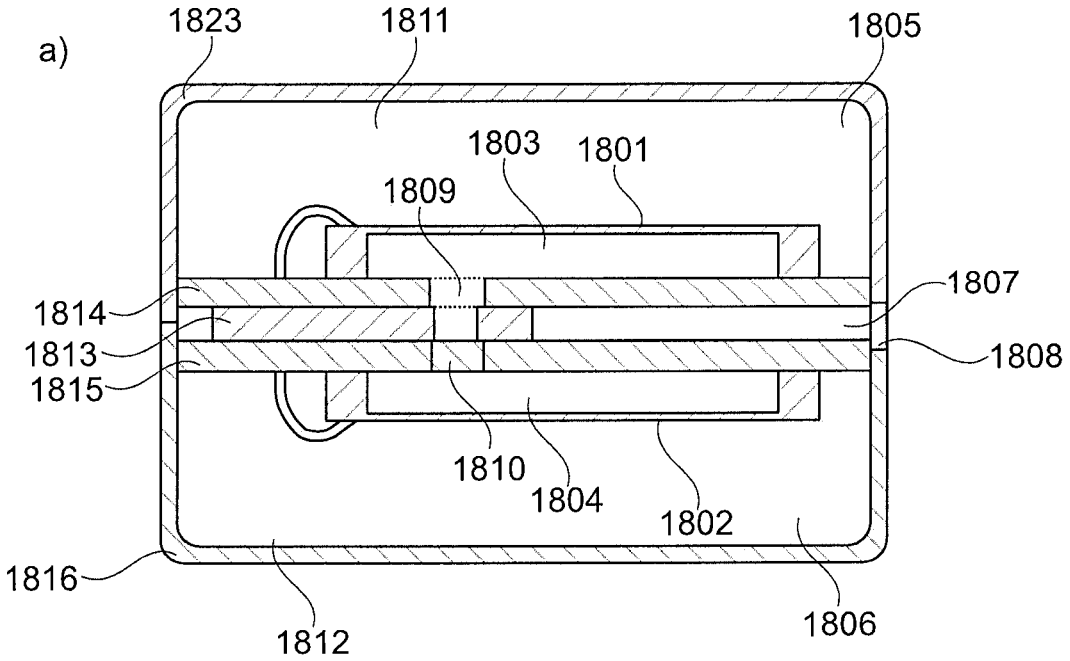
FIG. 18 shows a fourth miniature speaker assembly.
Figure 18:
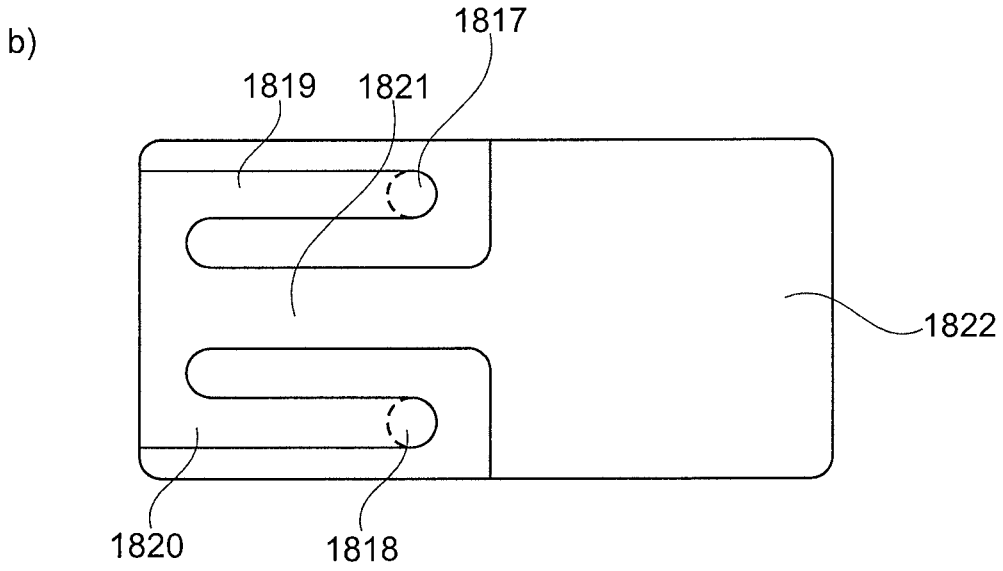

FIGS. 18*a* and 18*b* show yet another miniature speaker assembly 1800 still comprising two stacked miniature speakers of the type shown in FIG. 13. The embodiment depicted in FIG. 18*a* may be considered a compact version of the embodiment shown in FIG. 17. In FIGS. 18*a* and 18*b* the two miniature speakers are arranged within a speaker housing comprising a lower part 1816 and an upper part 1823. The acoustical mass of each miniature speaker is defined by the air volume in the respective sound channels 1819, 1820 and the common sound channel 1821 which is acoustically connected to the common front volume 1807 and the sound outlet 1808. In FIG. 18 the upper miniature speaker is acoustically connected with the sound channel 1819 via opening 1809 in the substrate 1814 in that the opening 1809 is aligned with region 1817 of the sound channel 1819. Similarly, the lower miniature speaker is acoustically connected with the sound channel 1820 via opening 1810 in the substrate 1815 in that the opening 1810 is aligned with region 1818 of the sound channel 1820. Regarding the upper speaker an intermediate volume 1803 is formed between the diaphragm 1801, the MEMS bulk and the substrate 11814. Regarding the lower speaker an intermediate volume 1804 is formed between the diaphragm 1802, the MEMS bulk and the substrate 1815. The sound channels 1819-1821 are provided within the intermediate piece 1813 arranged between the substrates 1814, 1815. Moreover, the miniature speaker assembly shown in FIG. 18 comprises respective rear volumes 1805, 1806. Again, the diaphragms 1801, 1802 may be driven by piezoelectric levers, cf. FIG. 2, or it may be implemented as an electrostatic diaphragm having an associated backplate, cf. FIG. 3. Preferably, the two miniature speakers of the assembly shown in FIG. 18 are identical. It should however be noted that they may in fact be different.

In the miniature speaker assemblies of FIGS. 15-18 two miniature speakers are arranged either next to each other or above each other in a stacked configuration. It should be noted that additional miniature speakers may be included so that the miniature assemblies comprise more than two miniature speakers.

The invention claimed is:

1. A miniature speaker having at least a first and a second resonance in its frequency response, the miniature speaker comprising a diaphragm for generating sound pressure waves in response to electrical drive signals, one or more sound channels at least partly surrounding a total air volume forming an acoustical mass, and one or more intermediate air volumes being acoustically connected to the one or more sound channels, and acoustically connected to the diaphragm, wherein the acoustical mass provides that the second resonance in the frequency response of the miniature speaker is positioned within an audible range, wherein the acoustical compliance of the one or more intermediate air volumes is/are smaller than the acoustical compliance of the diaphragm.

2. A miniature speaker according claim 1, wherein the diaphragm comprises a substantially plane diaphragm comprising a drive structure comprising a piezoelectric material layer arranged between a first and a second electrode.

3. A miniature speaker according to claim 1, further comprising an electrically conducting backplate arranged substantially parallel with the diaphragm, and wherein the substantially plane diaphragm is an electrically conducting diaphragm.

4. A miniature speaker according to claim 1, wherein the first resonance is within the range 1-5 kHz.

5. A miniature speaker according to claim 4, wherein the first resonance is within the range 3-4 kHz.

6. A miniature speaker according to claim 1, wherein the second resonance is within the range 3-10 kHz.

7. A miniature speaker according to claim 6, wherein the second resonance is within the range 6-9 kHz.

8. A miniature speaker according to claim 1, further comprising one or more rear volumes.

9. A miniature speaker according to claim 8, wherein the one or more intermediate air volumes has/have a total volume being smaller than 10% of the volume of the one or more rear volumes.

10. A miniature speaker according to claim 8, wherein the one or more intermediate air volumes has/have a total volume being smaller than 2% of the volume of the one or more rear volumes.

11. A miniature speaker according to claim 1, further comprising a damping arrangement for damping the frequency response of the miniature speaker.

12. A miniature speaker according to claim 1, wherein the diaphragm forms part of a MEMS die, and the one or more intermediate air volumes is/are at least partly defined between the diaphragm, a MEMS bulk and a substrate.

13. A miniature speaker according to claim 12, wherein the one or more sound channels is/are at least partly defined in the substrate.

14. A miniature speaker assembly comprising a plurality of miniature speakers according claim 1.

15. An in-ear piece for a hearing device, said in-ear piece comprising a miniature speaker according to claim 1.

16. A hearing device comprising an in-ear piece according to claim 15.

17. A miniature speaker having at least a first and a second resonance in its frequency response, the miniature speaker comprising a diaphragm, a low-mass motor for generating sound pressure waves in response to electrical drive signals, one or more sound channels at least partly surrounding a total air volume forming an acoustical mass, and one or more intermediate air volumes being acoustically connected to the one or more sound channels, and acoustically connected to the diaphragm, wherein the acoustical mass provides that the second resonance in the frequency response of the miniature speaker is positioned within an audible range, and wherein the acoustical compliance of the one or more intermediate air volumes is/are smaller than the acoustical compliance of the diaphragm.

18. A miniature speaker assembly comprising a plurality of miniature speakers according to claim 17.

19. An in-ear piece for a hearing device, said in-ear piece comprising a miniature speaker according to claim 17.

20. A miniature speaker having at least a first and a second resonance in its frequency response, the miniature speaker comprising a diaphragm for generating sound pressure waves in response to electrical drive signals, one or more sound channels at least partly surrounding a total air volume forming an acoustical mass, and one or more intermediate air volumes being acoustically connected to the one or more sound channels, and acoustically connected to the diaphragm, wherein the acoustical mass provides that the second resonance in the frequency response of the miniature speaker is positioned within an audible range, and wherein the first resonance is within the range 1-5 kHz or the second resonance is within the range 3-10 kHz.

* * * * *